US010220492B2

(12) United States Patent
Borders et al.

(10) Patent No.: US 10,220,492 B2
(45) Date of Patent: Mar. 5, 2019

(54) AIR HAMMER TOOL FOR INSTALLING ECCENTRIC LOCKING COLLAR ON A BEARING

(71) Applicant: Deere & Company, Moline, IL (US)

(72) Inventors: Andrew R. Borders, Davenport, IA (US); Amy B. Doroff, Highland Park, IL (US)

(73) Assignee: Deere & Company, Moline, IL (US)

( * ) Notice: Subject to any disclaimer, the term of this patent is extended or adjusted under 35 U.S.C. 154(b) by 434 days.

(21) Appl. No.: 14/827,874

(22) Filed: Aug. 17, 2015

(65) Prior Publication Data

US 2017/0050302 A1 Feb. 23, 2017

(51) Int. Cl.

*B25B 13/08* (2006.01)
*B25B 13/48* (2006.01)
*B25B 19/00* (2006.01)

(52) U.S. Cl.

CPC ..... *B25B 13/48* (2013.01); *B25B 13/08* (2013.01); *B25B 19/00* (2013.01); *Y10T 29/53104* (2015.01)

(58) Field of Classification Search

CPC ..... B25B 13/48; B25B 19/00; B25B 13/08; B25B 27/06; B25B 21/02; B25B 21/002; F16C 35/073; Y10T 29/53104

See application file for complete search history.

(56) References Cited

U.S. PATENT DOCUMENTS

| | | | | |
|---|---|---|---|---|
| 2,420,458 A * | 5/1947 | Barker | B25B 13/02 | 81/176.1 |
| 2,728,616 A | 12/1955 | Potter | | |
| 3,354,757 A * | 11/1967 | Grimm | B25B 13/04 | 411/410 |
| 4,713,881 A | 12/1987 | Lange et al. | | |
| D337,492 S | 7/1993 | Ryan et al. | | |
| 6,354,178 B2 * | 3/2002 | Pool | B25B 21/002 | 81/463 |
| 6,769,334 B1 * | 8/2004 | Whitehead | B25B 19/00 | 81/177.85 |
| 6,868,761 B2 * | 3/2005 | Stoick | B25B 13/02 | 81/120 |
| 2012/0074659 A1 * | 3/2012 | Fanourgiakis | B25B 31/00 | 279/145 |

* cited by examiner

*Primary Examiner* — Sarang Afzali
*Assistant Examiner* — Ruth G Hidalgo-Hernande
(74) *Attorney, Agent, or Firm* — Christopher R. Christenson; Kelly, Holt & Christenson PLLC

(57) ABSTRACT

A tool for installing a locking collar on a bearing using an air hammer is provided. The tool includes a first portion having an air hammer coupling portion configured to couple to the air hammer. A torque arm is coupled to the first portion. A collar-engaging portion is coupled to the torque arm and is configured to couple to a locking collar to impart rotational impacts to the locking collar when the air hammer is actuated.

17 Claims, 7 Drawing Sheets

AIR HAMMER TOOL FOR INSTALLING ECCENTRIC LOCKING COLLAR ON A BEARING

FIELD OF THE DISCLOSURE

The present invention relates to a tool for completing the installation of a shaft-journaling bearing of the type in which an extended inner race is engaged by an eccentric locking collar for locking the bearing in position on the shaft and, more particularly, a tool for assembling the locking collar to such a bearing and applying a selected locking torque.

BACKGROUND

Coupling an eccentrically-cammed locking collar with a similarly-cammed inner race of a bearing is well known for locking the bearing inner race to a shaft. Generally, the eccentric locking collar is manually assembled onto the shaft and hand-tightened to the inner race of the bearing. This manual step is typically followed by a final tightening operation that, in the past, has employed a hammer and drift, a spanner wrench or an impact wrench coupled to the locking collar using a specially designed tool that accesses the locking collar axially.

The discussion above is merely provided for general background information and is not intended to be used as an aid in determining the scope of the claimed subject matter.

SUMMARY

A tool for installing a locking collar on a bearing using an air hammer is provided. The tool includes a first portion having an air hammer coupling portion configured to couple to the air hammer. A torque arm is coupled to the first portion. A collar-engaging portion is coupled to the torque arm and is configured to couple to a locking collar to impart rotational impacts to the locking collar when the air hammer is actuated.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Installing an eccentric locking collar on an inner race of a bearing is a known, and common, technique for securing the bearing to a shaft. While more recent efforts have utilized an impact wrench in combination with a tool that fits over an axial end of the shaft to couple to an eccentric locking collar, such techniques are not without limitations. For example, while the utilization of the impact wrench improves the repeatability of the magnitude of torque that is applied to locking collars as they are assembled and coupled to inner races of bearings, the physical apparatus of the impact wrench in combination with the tool is somewhat unwieldly. For example, an impact wrench may weigh as much as 15 pounds. Further, the tool must access the locking collar axially along the shaft. In situations where the bearing is disposed at a distance from an end of the shaft, the tool used to couple the locking collar to the impact wrench can be somewhat heavy as well. For example, such a tool may weigh up to 12 pounds. While a combined apparatus weight of 27 pounds is readily hefted by a typical worker, requiring such worker to continually and/or repeatedly use the apparatus all day long is not optimal. Further still, since such tool must access the locking collar axially along the shaft, it is limited in situations where other structures, such as a pulley disposed on an end of the shaft, prohibits the tool from accessing the locking collar.

Figure 1A:
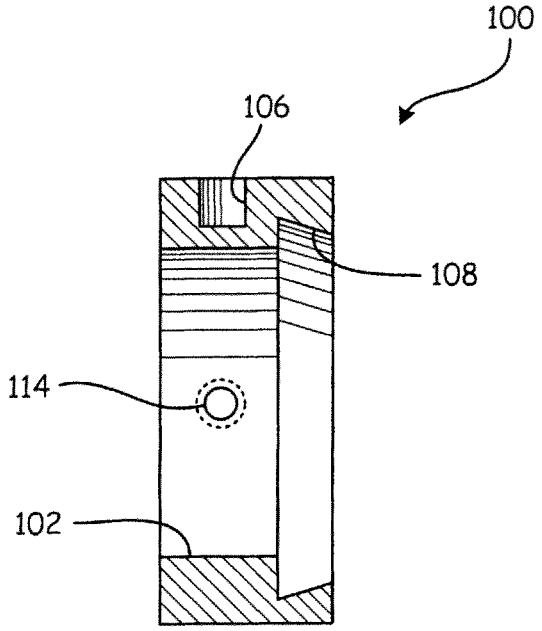
FIG. 1A is a diagrammatic cross-sectional view of an eccentrically-cammed locking collar with which embodiments of the present invention are particularly applicable.
Figure 1B:
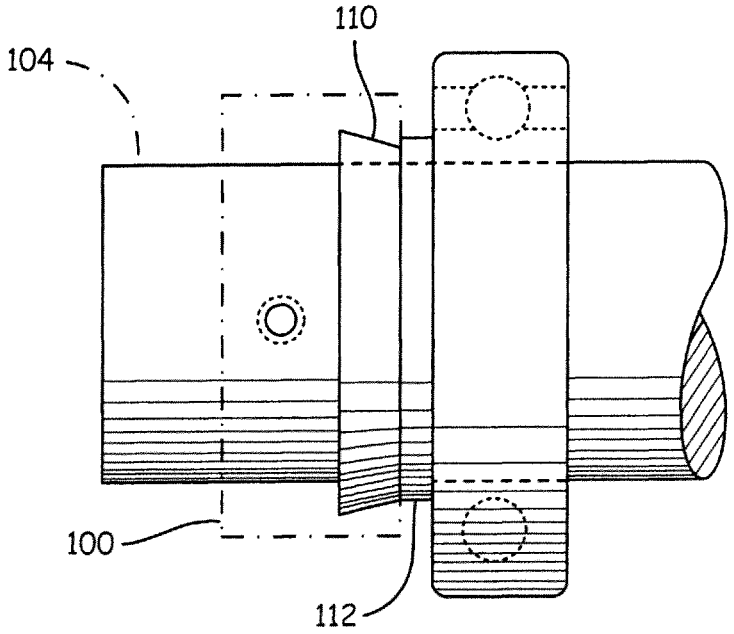
FIG. 1B is a diagrammatic view illustrating, in phantom, an eccentrically-cammed locking collar coupled to an inner race of a bearing.

FIG. 1A is as diagrammatic cross-sectional view of a typical locking collar with which embodiments of the present invention are particularly useful. Locking collar 100 generally has an inside diameter 102 that is configured to slidably pass a shaft, such as shaft 104 (shown in FIG. 1B). Locking collar 100 also includes drive hole 106 that may be engaged in order to rotate collar about shaft 104 relative to an inner race of the bearing during installation. Additionally, locking collar 100 also includes an inner race engaging surface 108 that mates with a corresponding cam portion 110 (shown in FIG. 1B) of inner race 112 of the bearing in order to secure locking collar 100 to inner race 112. Securing locking collar 100 to inner race 112 is first performed manually by rotating locking collar 100 in the direction of rotation of shaft 104. Final tightening of locking collar 100 is performed using a tool, such as that described below with respect to FIGS. 2-5. The relative rotation of locking collar 100 with respect to inner race 112 securely couples locking collar 100 to inner race 112. Then, a set screw or other suitable structure is driven through set screw aperture 114 in order to couple the entire assembly to shaft 104.

Figure 2:
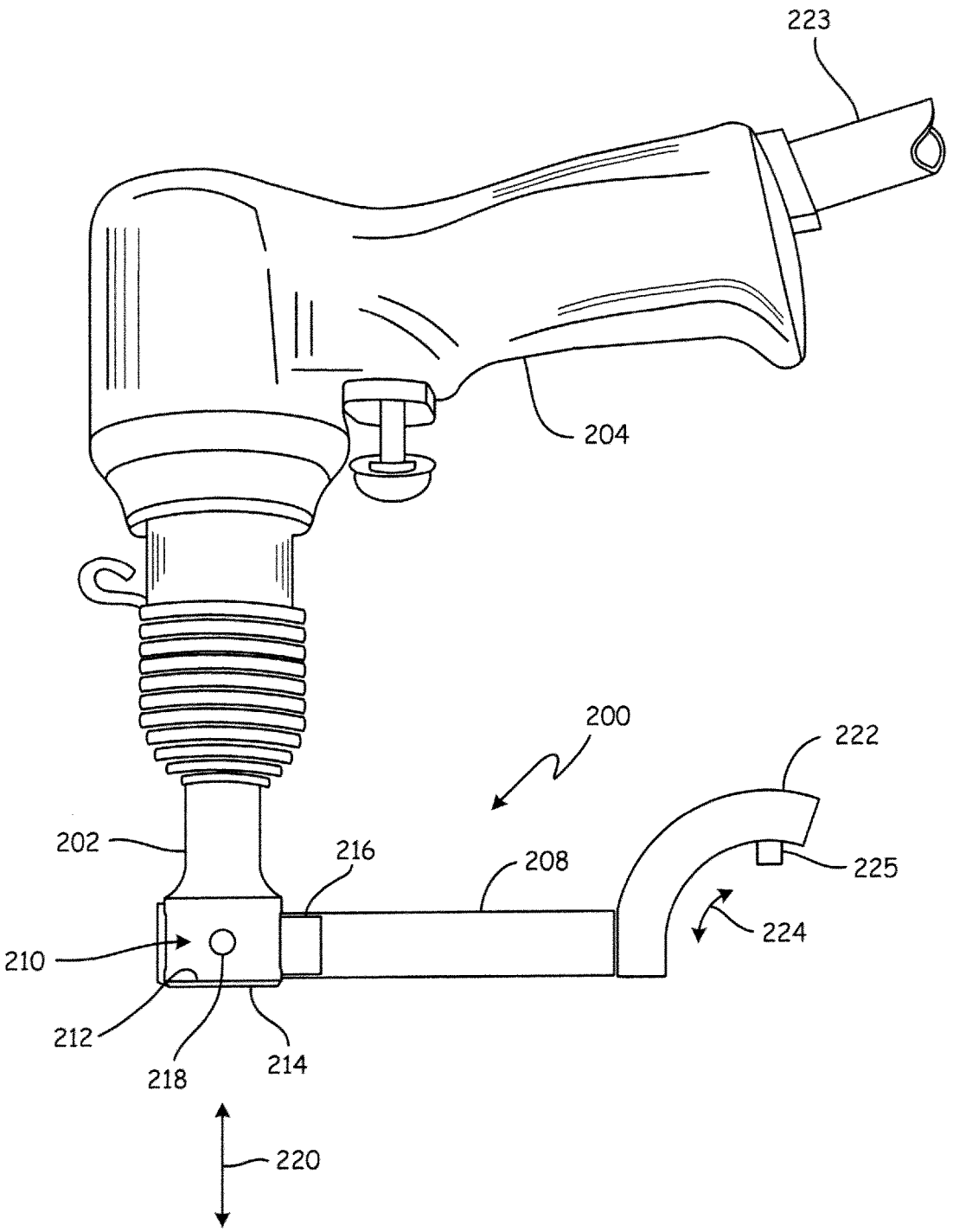
FIG. 2 is a diagrammatic view of a tool for installing an eccentrically-cammed locking collar coupled to an air hammer in accordance with an embodiment of the present invention.

FIG. 2 is a diagrammatic view of a tool for installing eccentric locking collars to bearings where the tool is coupled to air hammer 204, which is coupled to source 223 of compressed air. Tool 200 generally includes three portions. A first portion, 202, is designed to couple to a known air hammer, such as that shown at reference numeral 204. This coupling is generally provided by virtue of the design of air hammer coupling portion 206 (shown in FIGS. 3A and 3B).

Eccentric locking collar installation tool 200 also includes a second portion in the form of torque arm 208 that is coupled to first portion 202 at coupling 210. In the embodiment shown in FIG. 2, this coupling is provided in the form of a slot or aperture 212 that extends through end 214 of first portion 202. A tab 216 of portion 208 extends through slot 212. An aperture 218, receives a fastener that couples portion 202 to portion 208. In one embodiment, this fastener may be a threaded fastener, such as a screw or nut and bolt configuration. Additionally, in embodiments where torque arm 208 need not be removed from first portion 202, the fastener may simply be a press-fit pin. As can be appreciated, the axial movement of first portion 202, in the direction indicated by arrow 220, will generally impart rotation of locking collar engagement portion 222 in the direction indicated by arrow 220. Collar engaging portion 222 is coupleable to a locking collar by placing pin 225 within drive hole 104 of the locking collar. Additionally, while embodiments of the present invention can be formed of any suitable material, it is preferred that portions 202, 208 and 222 be formed of steel. More particularly, portions 202, 208 and 222 may be formed of tool steel, such as S-7 tool steel having a Rockwell C hardness in the range of 50-55. However, embodiments of the present invention can be practiced with softer grades of tool steel, or other grades of steel. Further still, embodiments may be practiced with steel having Rockwell C hardness as low as 45.

Embodiments of the present invention generally employ an air hammer, such as air hammer 204 that is coupled to a source of compressed air via line 223. Such an air hammer is generally lighter than an impact wrench that has been used in the past. Further still, tool 200 does not require axial access to the shaft. Instead, tool 200 may be employed at any position along the shaft in order to engage an eccentrically-cammed locking collar in accordance with embodiments of the present invention.

Figure 3A:
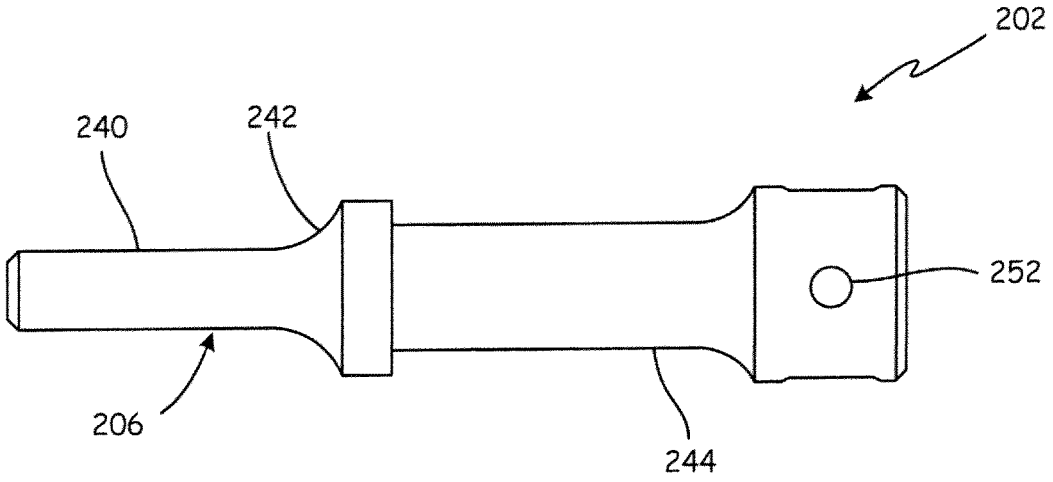
FIG. 3A is a side elevation view of an air hammer coupling portion of a tool in accordance with an embodiment of the present invention.

FIG. 3A is a side elevation view of an air hammer coupling portion of a tool in accordance with an embodiment of the present invention. Portion 202 includes air hammer engaging portion 206 that is generally formed of a solid cylinder 240 that is sized to fit within a tool-engaging portion of a standard air hammer, such as air hammer 204. In one embodiment, portion 206 is designed to allow rotation of the tool relative to air hammer. However, portion 206 may also include one or more features (such as those shown in FIG. 7) that cooperate with features of the air hammer to inhibit rotation of the tool relative to the air hammer. Further, portion 206 may be sized to couple to known air hammers. Thus, portion 206 may include a portion having a suitable outer diameter to be received by such air hammers. Suitable examples of such out diameters include 0.401 inches and 0.498 inches. Additionally, portion 206 also includes tapered portion 242 that has a gradually increasing diameter from that of cylindrical portion 240. Intermediate portion 244 is generally sized to provide sufficient reciprocating mass. For example, the diameter of portion 244 may be approximately 0.500 inches, while the diameter of portion 240 may be only 0.401 inches. Additionally, the length of portion 240, prior to tapered region 242 may, in one embodiment, be approximately 1.31 inches. The tapered portion 242 ensures that axial forces are robustly transferred to intermediate portion 244. In one embodiment, the radius of curvature of portion 242 is approximately 0.5 inches.

Figure 3B:
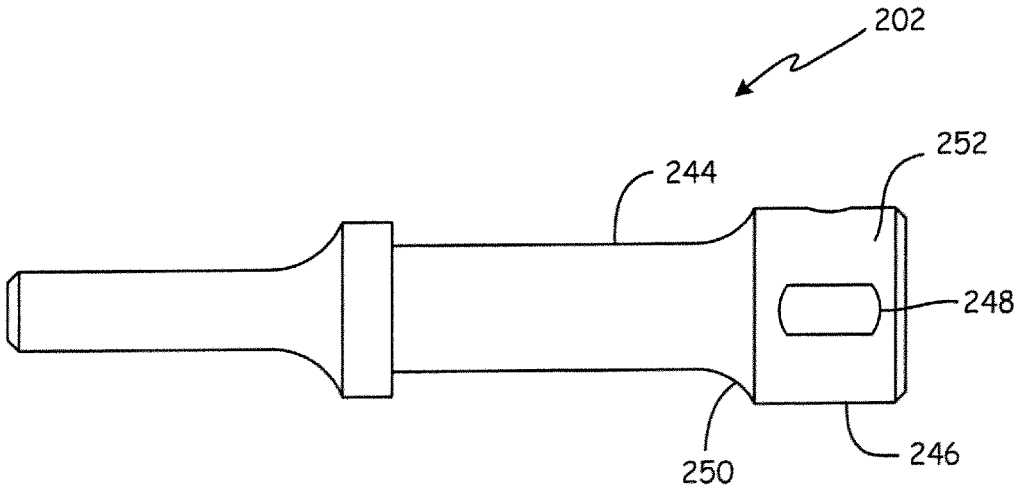
FIG. 3B is a top plan view of an air hammer coupling portion of a tool in accordance with an embodiment of the present invention.

As shown in FIG. 3B, intermediate portion 244 is coupled to torque arm-engaging portion 246. Portion 246 includes a slot 248 that is sized to receive tab 216 (shown in FIG. 4C). In one embodiment, intermediate portion 244 transitions to torque arm engaging portion 246 via a curved portion 250. In one embodiment, curved portion 250 as a radius of approximately 0.250 inches. As shown in FIGS. 3A and 3B, a fastener aperture 252 is provided to allow a fastener to engage an associated aperture 254 (shown in FIG. 4C) in order to secure tab 216 within aperture 248. In one embodiment, this fastener may be a threaded fastener. Accordingly, aperture 252 may be internally threaded in order to receive a threaded fastener.

Figure 4A:
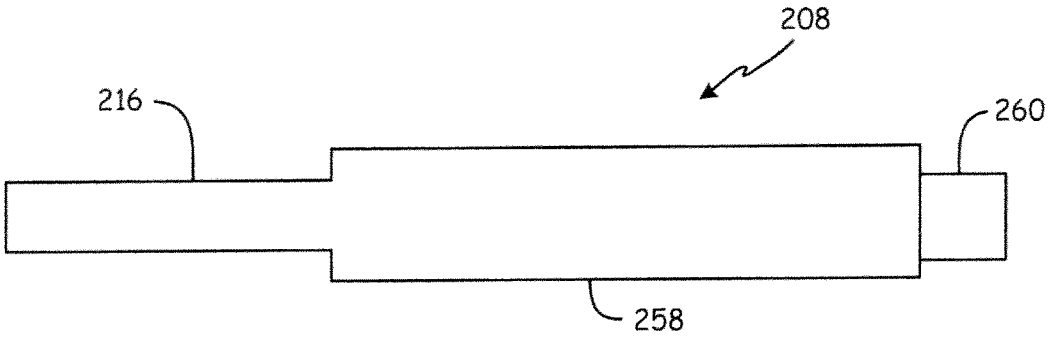
FIGS. 4A, 4B, and 4C are top plan, side elevation, and perspective views, respectively, of a torque arm of an eccentric collar installation tool in accordance with an embodiment of the present invention.
Figure 4B:
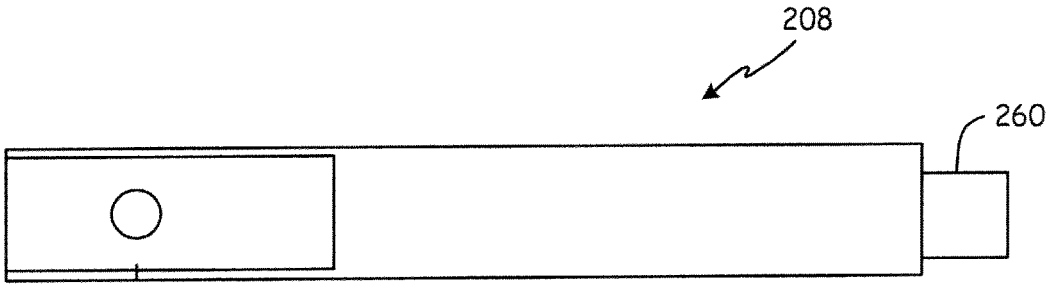
Figure 4C:
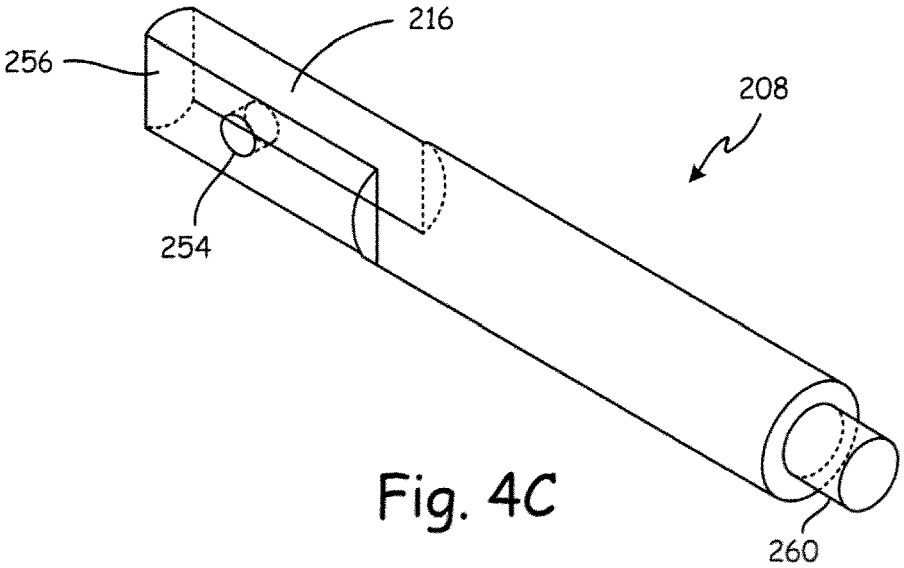

FIGS. 4A-4C are diagrammatic top-plan, side elevation, and perspective views, respectively, of a torque arm of a locking collar installation tool in accordance with an embodiment of the present invention. In the embodiment illustrated in FIGS. 4A-4C, torque arm 208 is cylindrically shaped. However, embodiments of the present invention can be practiced with torque arm 208 having any suitable cross-sectional shape. The overall size and shape of arm 208 should be selected in order to be sufficient to effectively convey the impacts received from the air hammer from first portion 202 to collar engaging portion 222. FIG. 4A shows torque arm 208 having tab 216 that is generally formed by removing material from the originally-shaped cylinder. The resulting shape is shown at reference numeral 256 in FIG. 4C. Torque arm 208 also includes elongate portion 258 that extends from tab 216 to coupling portion 260. In the embodiment shown in FIGS. 4A-4C, coupling portion 260 is generally provided in the form of a cylindrical portion having a reduced diameter in comparison to elongate portion 258. Cylindrical portion 260, in the described embodiment, cooperates with an internal aperture 262 (shown in FIG. 5C) in order to removably couple torque arm 208 to collar-engaging portion 222. However, those skilled in the art will recognize that collar-engaging portion 222 could, instead, have a protruding portion, such as portion 260 that is received within an aperture of torque arm 208. Further still, the mechanical coupling of torque arm 208 to collar-receiving portion 222 can take any suitable form. However, in some embodiments, this is a removable coupling such that torque arm 208 can be easily coupled to a variety of different collar-engaging portions 222 where each collar-engaging portion 222 is configured to engage a different type of eccentrically-cammed locking collar. For example, different eccentrically-cammed locking collars may have different outside diameters as well as different diameter driving apertures 106. By having an easily-removable collar engaging portion, a worker may have a variety of differently-sized collar-engaging portions 222 for use with a single portion 202 and torque arm 208. Then, as the worker uses the tool to install different locking collars, different appropriately-selected locking collar-engaging portions 222 can simply be coupled to torque arm 208. In such embodiments, all of the differently-sized collar-engaging portions 222 will have the same cooperative feature 262 such that they may all easily engage torque arm 208.

FIGS. 5A-5D are top plan, side elevation, front elevation, and perspective views, respectively, of a collar-engaging portion of a collar installation tool in accordance with an embodiment of the present invention.

Figure 5A:
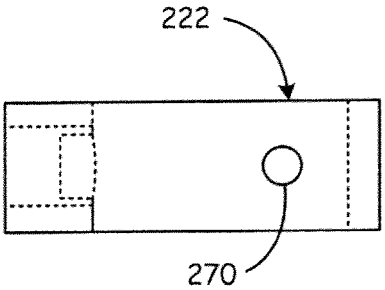
FIGS. 5A-5D are top plan, side elevation, right elevation, and perspective views, respectively, of a collar-engaging portion of an eccentric locking collar installation tool in accordance with an embodiment of the present invention.
Figure 5B:
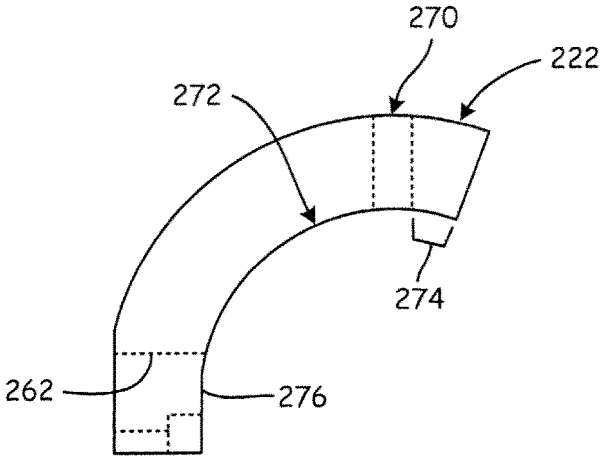
Figure 5C:
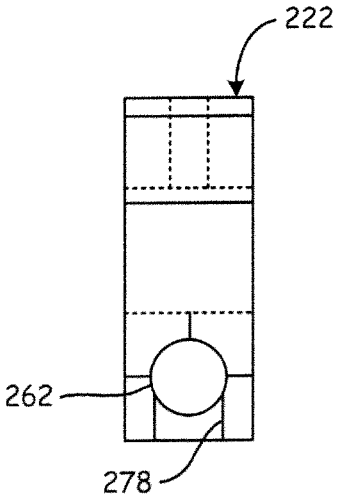
Figure 5D:
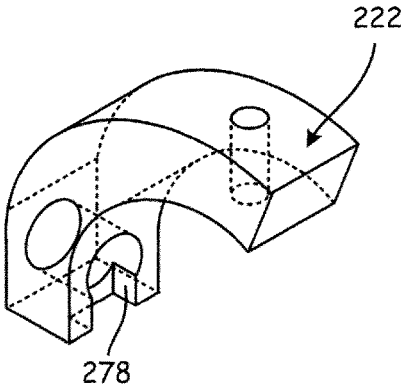

FIG. 5A illustrates collar engaging portion 222 having an aperture 270 that is sized to receive and securely mount a pin that is sized to engage driving aperture 106 of a particular type of locking collar. In one embodiment, aperture 270 is sized to receive the pin for a press-fit. However, embodiments can be practiced where collar engaging portion 222 is coupled to a pin or other suitable structure using any suitable technique. As shown in FIG. 5B, collar engaging portion 222 generally has an inner diameter 272 that is configured to substantially match an outer diameter of a locking collar, such as locking collar 100 (shown in FIG. 1A). Moreover, the position of aperture 270 is such that the pin mounted therein will align with and engage driving aperture 106 thereby allowing collar engaging portion 222 to be releasably coupled to the locking collar. When so coupled, rotation of collar engaging portion 222 will impart associated rotation of the locking collar. As shown in FIG. 5B, collar engaging portion 222 extends angularly beyond aperture 270 at portion 274 in order to provide a robust structure that maintains the pin within aperture 270 over the course of repeated locking collar installations without fracturing collar engaging portion 222. Collar engaging portion 222 extends approximately 90 degrees from aperture 270 to torque arm engaging region 276. Torque arm engaging region 276 includes, in the embodiment shown, aperture 262 extending therethrough and configured to receive cylindrical portion 260 of torque arm 208. As shown in FIGS. 5C and 5D, a small cutout portion 278 may be provided in order to allow access to cylindrical portion 260. Additionally, an end of cylindrical portion 260 may be machined, or otherwise configured to receive a key or other structure at cutout region 278 such that locking collar engaging portion 222 does not rotate about cylindrical portion 260. However, other suitable techniques for inhibiting such rotation can be used in accordance with the embodiments of the present invention.

Figure 6:
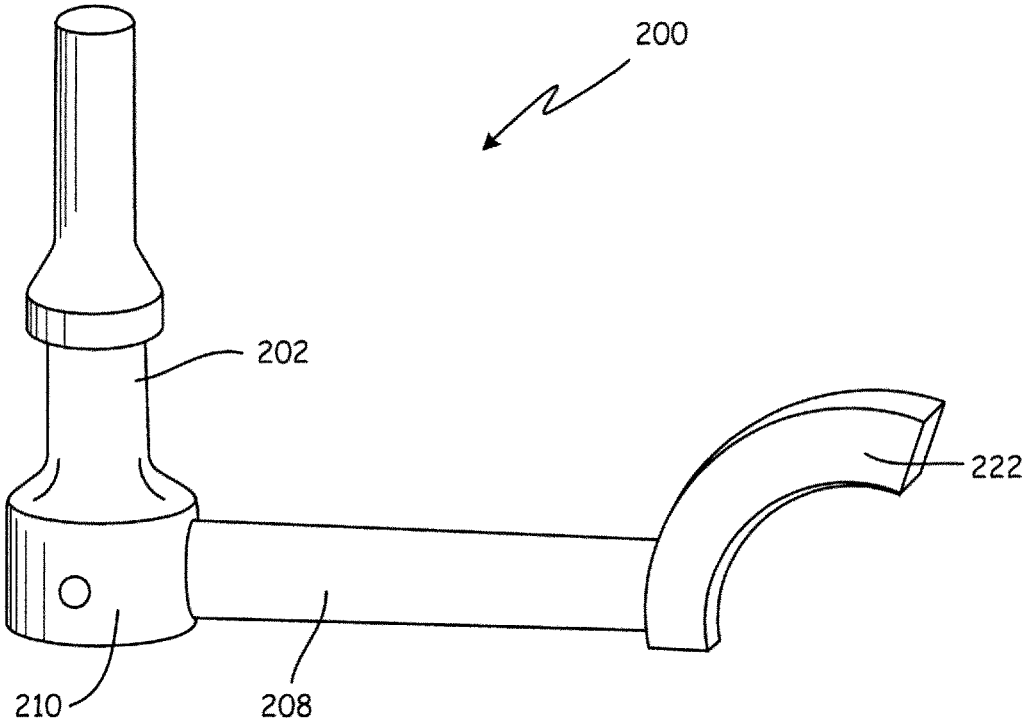
FIG. 6 is a diagrammatic view of an assembled eccentric locking collar installation tool in accordance with an embodiment of the present invention.

FIG. 6 is a diagrammatic view of a fully assembled locking collar installation tool in accordance with an embodiment of the present invention. As shown, tool 200 includes torque arm 208 passing through and being at coupling 210. Additionally, collar engaging portion 222 is coupled to torque arm 208 as shown. Tool 200 generally provides a relatively robust locking collar installation tool that can access a locking collar at any portion along the shaft regardless of whether any structures are mounted on an end of the shaft. Moreover, the apparatus is relatively lightweight in comparison to impact wrench driven tools. Further still, the tool may driven by a commercially-available air hammer which is highly efficient at generating effective impacts with relatively little weight. Further, tool 200 includes a reciprocating mass in portion 202 that is disposed on one side of torque arm 208 from locking collar engaging portion 222. Thus, the impacts of the air hammer are transformed into significant torsional impacts on collar engaging portion 222 via the length of torque arm 208. In this way, significant physical impacts can be easily directed to a locking collar via a relatively lightweight system.

Figure 7:
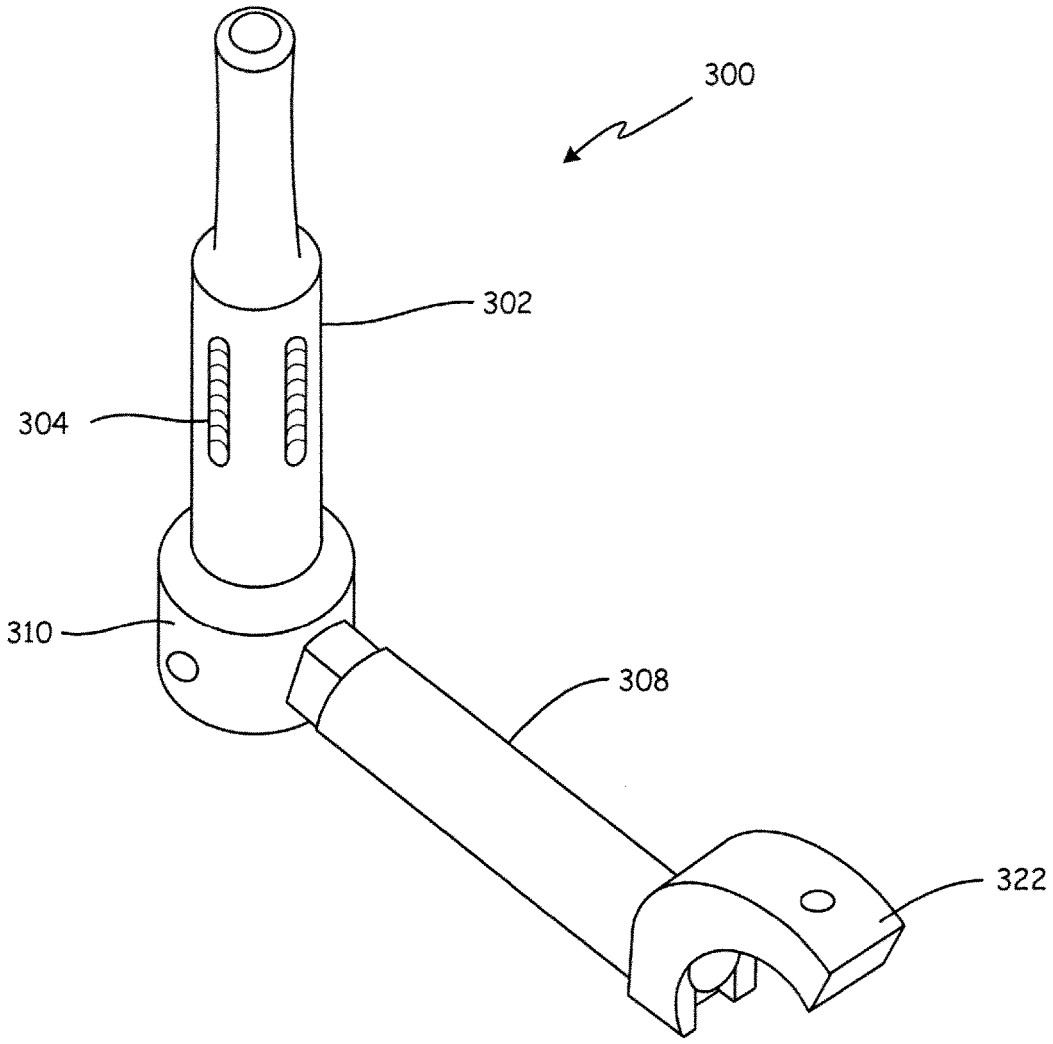
FIG. 7 is a diagrammatic view of an assembled eccentric locking collar installation tool in accordance with another embodiment of the present invention.

FIG. 7 is a diagrammatic view of an assembled eccentric locking collar installation tool in accordance with another embodiment of the present invention. Tool 300 bears some similarities to tool 200 and like components are numbered similarly. Tool 300 includes a first portion 302 that is configured to couple to an air hammer. However, portion 302 includes a number of grooves 304 that are aligned with the longitudinal axis of portion 302. In the embodiment shown in FIG. 7, portion 302 includes four such grooves 304, although only two are shown. Grooves 304 cooperate with corresponding features of an air hammer to which portion 302 couples in order to inhibit rotation of tool about the longitudinal axis of portion 302. Portion 302 is coupled to torque arm 308 at coupling 310. Additionally, collar engaging portion 322 is coupled to torque arm 308. In one embodiment, collar engaging portion 322 may be releasably coupled to torque arm 308 in order to allow a variety of different collar engaging portions 322 to be used.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tool for installing a locking collar on a bearing, the tool comprising:
- a first portion having an air hammer coupling portion configured to couple to an air hammer;
- a second portion comprising a torque arm coupled to the first portion; and
- a curved collar engaging portion coupled to the torque arm, the collar engaging portion having a curved inner surface and a pin extending from the curved inner surface, and wherein axial movement of the first portion directly imparts rotational motion to the curved collar engaging portion.

2. The tool of claim 1, wherein the first portion includes a cylinder that is sized to fit within the air hammer.

3. The tool of claim 2, wherein the cylinder has a diameter of about 0.401 inches.

4. The tool of claim 2, wherein the cylinder has a diameter of about 0.498 inches.

5. The tool of claim 1, wherein the collar engaging portion has an inner diameter that is sized to match an outer diameter of the locking collar.

6. The tool of claim 5, wherein the collar engaging portion extends from a pin to a torque arm engaging region.

7. The tool of claim 6, wherein the collar engaging portion extends about 90 degrees from the pin to the torque arm engaging region.

8. The tool of claim 1, wherein the first portion, torque arm, and collar engaging portion are formed of tool steel.

9. The tool of claim 8, wherein the tool steel is hardened to a Rockwell C hardness in the range of 50-55.

10. The tool of claim 1, wherein the torque arm includes a tab that is received by an aperture defined in the first portion.

11. The tool of claim 10, and further comprising an aperture in the first portion that is configured to receive a fastener to secure the torque arm within a slot.

12. The tool of claim 1, wherein the first portion includes an intermediate portion having a larger diameter than the hammer coupling portion.

13. The tool of claim 1, wherein the torque arm includes a coupling portion that is configured to releasable couple to the collar engaging portion.

14. The tool of claim 1, wherein the torque arm has a cylindrical shape.

15. An arrangement for installing a locking collar on a bearing, the arrangement comprising:
- an air hammer coupled to a source of compressed air; and
- an air hammer tool coupled to the air hammer, the air hammer tool including:
  - a torque arm operably coupled to the air hammer; and
  - a curved collar engaging portion coupled to the torque arm, the collar engaging portion having a curved inner surface and a pin extending from the curved inner surface, and wherein axial movement of the air hammer tool directly imparts rotational motion to the curved collar engaging portion.

16. The arrangement of claim 15, wherein the air hammer tool is coupled to the air hammer in a configuration that allows rotation of the air hammer tool about the air hammer.

17. The arrangement of claim 15, wherein the air hammer tool is coupled to the air hammer in a configuration that does not allow rotation of the air hammer tool about the air hammer.

* * * * *